US006314781B1

(12) United States Patent
Nagase

(10) Patent No.: US 6,314,781 B1
(45) Date of Patent: Nov. 13, 2001

(54) METHOD OF WIRE ROLLING AND ROLLING MILL

(75) Inventor: Tadahiro Nagase, Nagoya (JP)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 09/543,874

(22) Filed: Apr. 6, 2000

(30) Foreign Application Priority Data

Apr. 15, 1999 (JP) ..... 11-108647

(51) Int. Cl.[7] ..... B21B 39/00
(52) U.S. Cl. ..... 72/226; 72/234
(58) Field of Search ..... 72/224, 225, 226, 72/228, 233, 234

(56) References Cited

U.S. PATENT DOCUMENTS 4,347,725 * 9/1982 Denny ..... 72/234
4,382,376 * 5/1983 Brauer et al. ..... 72/205
5,307,663 * 5/1994 Shore et al. ..... 72/228
5,566,564 * 10/1996 Brauer ..... 72/226
5,666,843 * 9/1997 Muller ..... 72/234
5,862,699 * 1/1999 Lestani et al. ..... 72/226
5,896,288 * 4/1999 Shore ..... 72/228

* cited by examiner

*Primary Examiner*—Ed Tolan

(57) ABSTRACT

In a rolling mill, a mini block (MBM) is installed between a block mill (BM) and a sizing mill (SM) as a reducer for intermediate rolling. The block mill (BM) is so constructed that it is possible to use both a front group (BM1) and a rear group (BM2) of the rollers, or only the front group by by-passing the rear group with a dummy pass, or to by-pass both the front and the rear groups. The mini block mill (MBM) is shuntable from the pass line. The sizing mill is so constructed with two sets of rollers (SM1, SM2) that either both the sets may be used, or only one of the sets (SM1) may be used and the other (SM2), by-passed. By choosing combinations of use and non-use of the rollers it is possible to produce wires of various diameters from a round rod material of one diameter.

2 Claims, 7 Drawing Sheets

METHOD OF WIRE ROLLING AND ROLLING MILL

BACKGROUND OF THE INVENTION

1. Field of the Invention

The present invention relates to improvement in rolling metal rods, particularly, steel rods, to produce steel wires. According to the present invention it is possible to produce wire of various diameters staring from a rod of one diameter without change rollers.

2. Description of the Prior Art

Production of wires of diameters in the range of several millimeters to twenty millimeters by wire rolling of steel rods has been usually carried out by using a material round rod having a diameter of 20 mm or so supplied from rough rolling step, rolling the material in a block mill equipped with eight rollers as intermediate rolling mill, and then, finish rolling the wire with a sizing mill equipped with sets of two rollers. Structure of the rolling mill is as shown in FIG. 1.

There is strict requirement to sizes of steel wires depending on the ultimate use thereof. For example, in the range of diameter of 5–10 mm, products having the sizes of each 0.5 mm increase are required, and in the range of diameter 10–20 mm, those having the sizes of each 1.0 mm increase are required. Recently, a demand has arisen for hot rolled wire products of various calibres which precisely conform with the required cross-section.

A conventional method for satisfying this demand is the sequence of the following rolling steps illustrated in FIG. 2.

In the range of "very fine" (diameters 5.5, 6.0 and 6.5 mm) wire rolling starts from a round rod of diameter 16.4 mm supplied from rough intermediate line. The rod material is first rolled by a block mill (F1–F8) having the first roller group to diameter 6.5 mm, then the rolled material is passed to the sizing mill to be rolled by both the front group of the rollers and the rear group of the rollers (5.5 mm), or by only the front group of the rollers (6.0 mm).

In the range of "fine" (diameters 7.0, 7.5 and 8.0 mm) a round rod of diameter 20.5 mm is used as the material from the rough intermediate line. In order to switch to this range, it is necessary to shut down the line to carry out roller change of all the stands, and form a block mill (F1–F8) having the second roller group. After rolling the round rod material of diameter 20.5 mm to 8.4 mm, the rolled material is passed to the sizing mill so that it may be rolled by both the front group and the rear group (7.0 mm), by only the front group (7.5 mm), or by only the front group of changed rollers.

In the range of "intermediate fine" (diameters 8.5, 9.0, 9.5 and 10.0 mm) as shown in FIG. 3, rolling also starts from the same round rod material of diameter 20.5 mm as above. The round rod material is rolled by a part (F1–F6) of the block mill having the second group of rollers to diameter 10.5 mm. For this purpose it is also necessary, after shutting down the line, to remove the rollers of F7 and F8 stands, and to install a dummy guide. The rolled material coming out of the dummy guide is passed to the sizing mill so as to use both the front and the rear groups of rollers (8.5 mm), only the front group (9.5 mm), or with changed rollers, only the front and rear group (9.0 mm), or only the rear group (10.0 mm).

In the range of "intermediate bold" (diameters 11.0 and 12.0 mm), the rolling also starts from the round rod material of diameter 20.5 mm. The material is rolled by a part (F1–F4) of the block mill having the second group of rollers to diameter 13.1 mm. Also in this case the rollers of F5 and F6 stands are removed and replaced with a dummy guide. The rolled material of diameter 13.1 mm is passed to the sizing mill, and rolled by both the front group and the rear group of the rollers (11.0 mm), or by only the front group (12.0 mm).

With reference to FIG. 4, production of wires in the thickness range of "bold" (diameters 13.0, 14.0, 15.0 and 16.0 mm) starts also from the round rod of diameter 20.5 mm, which is first rolled by a part (F1–F2) of the second group of rollers to diameter 16.4 mm. Block mill rollers of F3 and F4 stands are also removed. The rolled material of diameter 16.4 mm is passed to the sizing mill and rolled by both the front and the rear group of the rollers (13.0 mm), or by only the rear group (15.0 mm). Alternatively, the rolled material is rolled, after changing rollers, by both the front and rear groups (14.0 mm) or by only the rear group (16.0 mm).

Wires in the thickness range of "very bold" (diameters 17.0, 18.0 and 19.0 mm) are produced, also starting from the round rod material of diameter 20.5 mm, by not using the block mill but directly using the sizing mill. Both the front and the rear groups of the rollers are used (17.0 mm), only the front group is used (19.0 mm) or both the front and the rear groups with changed rollers are used (18.0 mm).

In FIG. 2 to FIG. 4 demarcation with lines indicates that rollers are used in the areas and that no roller is used in the other area. The round forms illustrate that calivers of the rollers (consequently, the sections of the rolled material coming therefrom) are round, and the oval form, oval sections of the rolled materials. The numerical figures annexed to the round forms show the diameters of the material coming out of the round caliber rollers.

Change of sizing mill rollers is easy, and even the whole roll stands can be changed. However, because ratios of rotating speeds of the rollers are fixed in the block mills, it is necessary to use continued stands. Also, because the roller axes are set fixedly to the pass line, it is necessary to carry out roller changing after interrupting the rolling operation in which the block mill is involved. In regard to the above described examples, in the thickness ranges of "very fine" and "fine" entire stands of the block mill are changed. Changes between the thickness range of "fine" and "intermediate fine", "intermediate fine" and "medium bold", and "medium bold" and "bold" necessitate mounting and demounting of the rear group rollers.

Thus, attempt to produce steel wires of various sizes by the conventional technology requires troublesome preliminary work for roller change, and this lowers efficiency of production. If, however, large scale production of one size at once is done for the purpose of avoiding the above problems, then, excessive stock of the wire product must be kept in inventory. Additional problems such as scratching during handling and transporting and rusting during storage may occur.

The object of the present invention is to solve the above discussed problems relating to wire rolling, and to provide a method of rolling which enables production of wire products having various diameters from a round rod of one diameter without change of block mill rollers, is a lengthy and laborious process. The invention also provides a rolling mill for carrying out the rolling method.

SUMMARY OF THE INVENTION

According to one aspect of the invention there is provided a method of rolling wire rods having selected final diameters from a rod of a single diameter supplied from a roughing mill along a pass line wherein the mill includes in intermediate block mill for receiving rod from the roughing mill, the block mill having rollers arranged in a front group and a rear group, each of which can be dummied, a mini block mill for receiving rod from the block mill which is shuntable from the pass line, and a sizing mill for receiving rod from the mini block mill, the sizing mill having plural sets of rollers, at least one of which sets is shuntable from the pass line, said method comprising selecting combinations of the block mill roller groups, mini block mill and sizing roller sets and rolling rod through the selected combination so as to produce a wire rod having a desired final calibre.

In another aspect there is provided a rolling mill for rolling wire rod having selected final diameters from a single diameter supplied from a roughing mill along a pass line, said rolling mill comprising an intermediate block mill for receiving rod from a roughing mill, the block mill having a front group of rollers and a rear group, each of which can be independently dummied, a mini block mill for receiving rod from the block mill which can be shunted between an operative position on the pass line and a non-operative position away from the pass line and a sizing mill comprising at least two sets of rollers, at least one of which sets of capable of being shunted between an operative position on the pass line and a non-operative position away from the pass line, the rollers of the block mill, mini block mill and sizing mill being selectable in various combinations to produce wire rod of desired calibre from a single diameter wire rod supplied by the roughing mill.

These and other features and objectives of the present invention will now be described in greater detail with reference to the accompanying drawings, wherein:

Figure 1:
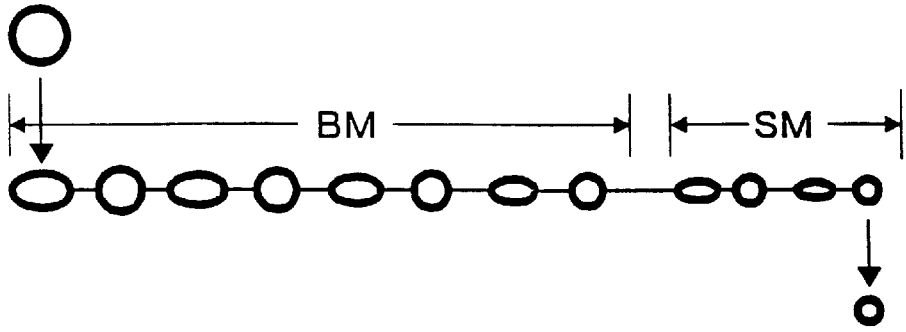
FIG. 1 PRIOR ART
FIG. 1 is a schematic diagram showing roller distribution in a conventional wire rolling mill.
Figure 5:
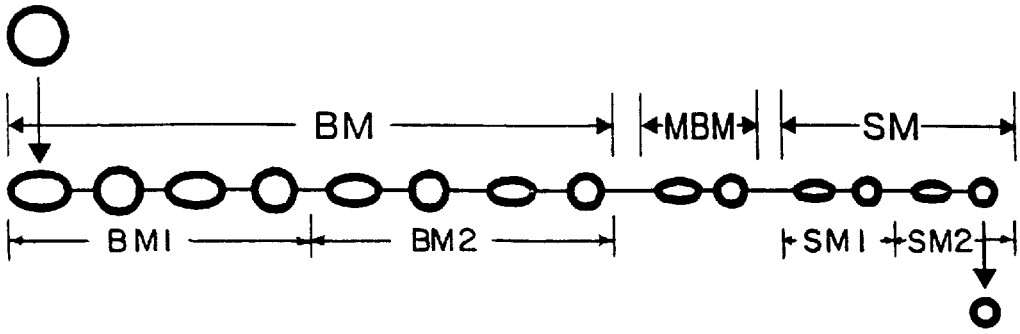
FIG. 5 is a schematic diagram corresponding to FIG. 1 showing roller distribution in a wire rolling mill according to the present invention.

The method of rolling according to the present invention which achieves the above object is a method of wire rolling of metal rods supplied from rough rolling step by intermediate rolling with a block mill and finish rolling with a sizing mill to form wire products. The method uses a rolling mill, which comprises, as illustrated in FIG. 5, a block mill (BM), a sizing mill (SM) and a mini block mill (MBM) installed between the BM and the SM as a reducer. Rollers of the block mill (BM) are divided into two groups, the front group and the rear group, so as to make it possible either to use both the front and the rear groups, to use only the front group by dummy passing the rear group, or to use no block mill (BM) by by-passing the material to be rolled through another guide. The mini block mill (MBM) is shuntable from the pass line, The sizing mill (SM) consists of plural sets of rollers, and at least one of the sets is shuntable from the pass line. Combinations of use and non-use of the rollers can be chosen so that it may be possible to produce wires of different diameters from a material round rod of one diameter.

The rolling mill for carrying out the above described method of rolling is the rolling mill for wire rolling of metal rods supplied from rough rolling step by intermediate rolling with a block mill and finish rolling with a sizing mill for form wire products. The rolling mill comprises, as illustrated in FIG. 5, a block mill (BM), a sizing mill (SM) and a mini block mill (MBM) installed between the block mill and the sizing mill as a reducer. Rollers of the block mill (BM) are divided into two groups, the front group and the rear group, so as to make it possible either to use both the front and the rear groups or only the front group by passing the rear group with a dummy pass (DP1); and a guide or guides for by-passing (BP) the material to be rolled). The mill also has another dummy pass (DP2), and thus, the mini block mill is shuntable from the pass line. The sizing mill consists of plural sets of rollers, and at least one of the sets is shuntable from the pass line. Combinations of use and non-use of the rollers can be chosen so as to make it possible to produce wires of different diameters from a material round rod of one diameter.

The by-passes for the rollers can be provided by installing guides to pass the rolled wires or the material wires to be rolled in suitable positions in close vicinity to the center of the rolling line without interference to the rollers or to changing the rollers.

Combinations of paths through which the material rods and the rolled wires run are tabulated below. In the table, "Case A" contains the cases with use of the block mill, and "Case B", without use. The abbreviations in the table have the following meanings:

| | |
|---|---|
| BM | block mill |
| BM1 | front group of rollers of the block mill |
| BM2 | rear group of rollers of the block mill |
| MBM | mini block mill |
| SM1, 2 | sizing millS |
| BP | by-pass |
| DP1-3 | dummy pass |
| a-t | roller pair of the sizing mill |

TABLE I

Case A

| Case | Block Mills | Reducer | Sizing Mills |
|---|---|---|---|
| 1 | BM1 BM2 | MBM | SM1(a) SM2(b) |
| 2 | BM1 BM2 | MBM | SM1(a) DP3 |
| 3 | BM1 BM2 | DP2 | SM1(c) SM2(d) |
| 4 | BM1 BM2 | DP2 | SM1(e) DP3 |
| 5 | BM1 BM2 | DP2 | SM1(f) SM2(g) |
| 6 | BM1 BM2 | DP2 | SM1(f) DP3 |
| 7 | BM1 DP1 | MBM | SM1(h) SM2(i) |
| 8 | BM1 DP1 | MBM | SM1(h) DP3 |
| 9 | BM1 DP1 | MBM | SM1(j) SM2(k) |
| 10 | BM1 DP1 | MBM | SM1(j) DP3 |
| 11 | BM1 DP1 | MBM | SM1(1) SM2(m) |

TABLE I-continued

Case A

| Case | Block Mills | Reducer | Sizing Mills |
|---|---|---|---|
| 12 | BM1 DP1 | MBM | SM1(1) DP3 |
| 13 | BP1 | MBM | SM1(o) SM2(p) |
| 14 | BP1 | MBM | SM1(o) DP3 |
| 15 | BP1 | MBM | SM1(q) SM2(r) |
| 16 | BP1 | MBM | SM1(q) DP3 |
| 17 | BP1 | DP2 | SM1(r) SM2(s) |
| 18 | BP1 | DP2 | SM1(r) DP3 |
| 19 | BP1 | DP2 | SM1(s) SM2(t) |

TABLE II

Case B

| Case | Intermediate | Block Mills | Reducer | Sizing Mills |
|---|---|---|---|---|
| 1 | H21 V22 | BM1 BM2 | MBM | SM1(a) SM2(b) |
| 2 | H21 V22 | BM1 BM2 | MBM | SM1(a) DP3 |
| 3 | H21 V22 | BM1 BM2 | DP2 | SM1(c) SM2(d) |
| 4 | H21 V22 | BM1 BM2 | DP2 | SM1(e) DP3 |
| 5 | H21 V22 | BM1 BM2 | DP2 | SM1(f) SM2(g) |
| 6 | H21 V22 | BM1 BM2 | DP2 | SM1(f) DP3 |
| 7 | H21 V22 | BM1 DP1 | MBM | SM1(h) SM2(i) |
| 8 | H21 V22 | BM1 DP1 | MBM | SM1(h) DP3 |
| 9 | H21 V22 | BM1 DP1 | MBM | SM1(j) SM2(k) |
| 10 | H21 V22 | BM1 DP1 | MBM | SM1(j) DP3 |
| 11 | H21 V22 | BP1 | MBM | SM1(1) SM2(m) |
| 12 | H21 V22 | BP1 | MBM | SM1(f) DP3 |
| 13 | H21 V22 | BP1 | DP2 | SM1(o) SM2(p) |
| 14 | H21 V22 | BP1 | DP2 | SM1(o) DP3 |
| 15 | H21 V22 | BP1 | DP2 | SM1(q) SM2(r) |
| 16 | H21 V22 | BP1 | DP2 | SM1(q) DP3 |
| 17 | DP1 | BP1 | DP2 | SM1(r) SM2(s) |
| 18 | DP1 | BP1 | DP2 | SM1(r) DP3 |
| 19 | DP1 | BP1 | DP2 | SM1(s) SM2(t) |

Figure 2:
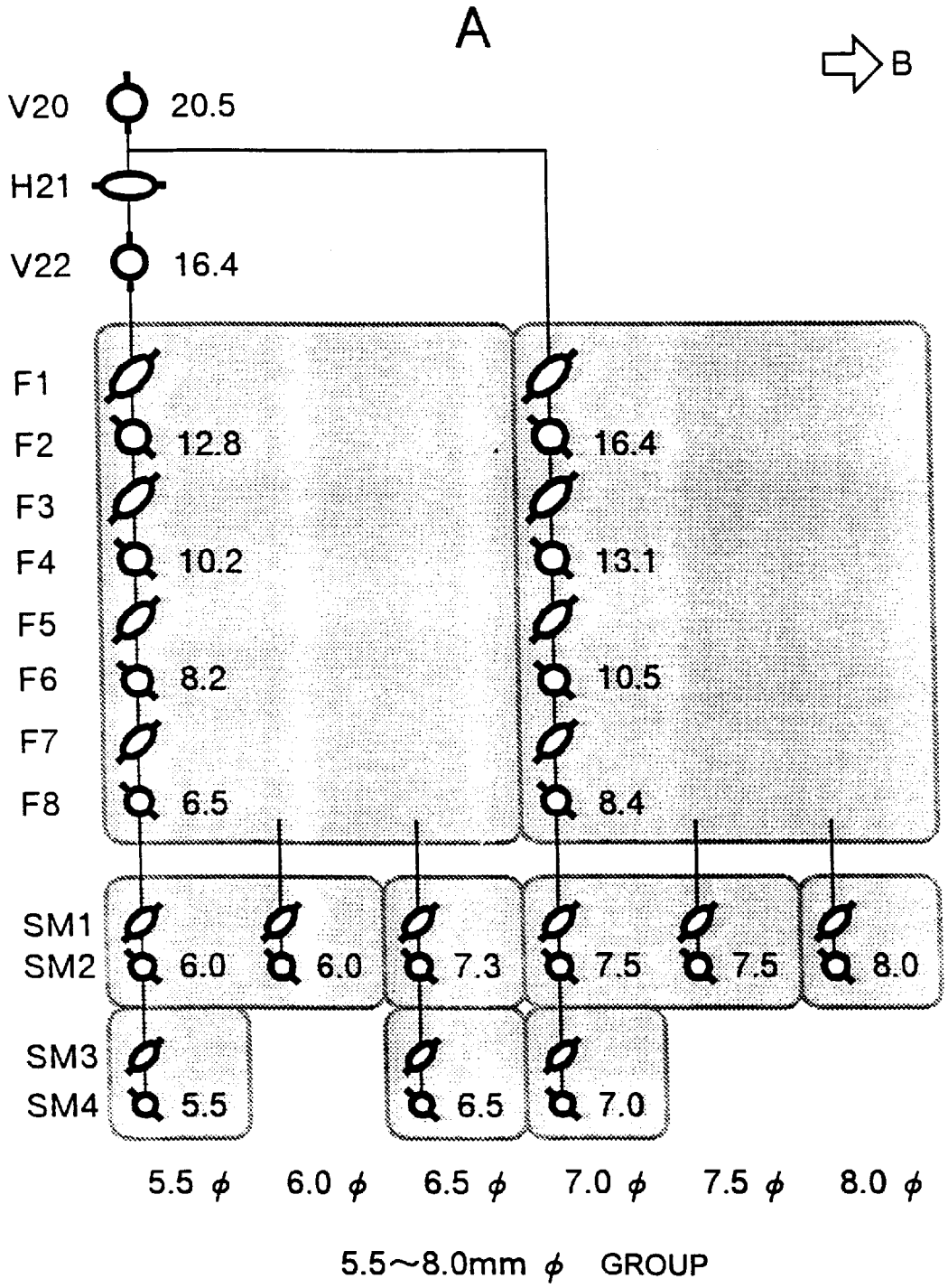
FIG. 2 PRIOR ART
FIG. 2 is an explanation for rollers used, sections and diameters of the material in the process of rolling when wires of various sizes are produced by using the wire rolling mill shown in FIG. 1.
Figure 3:
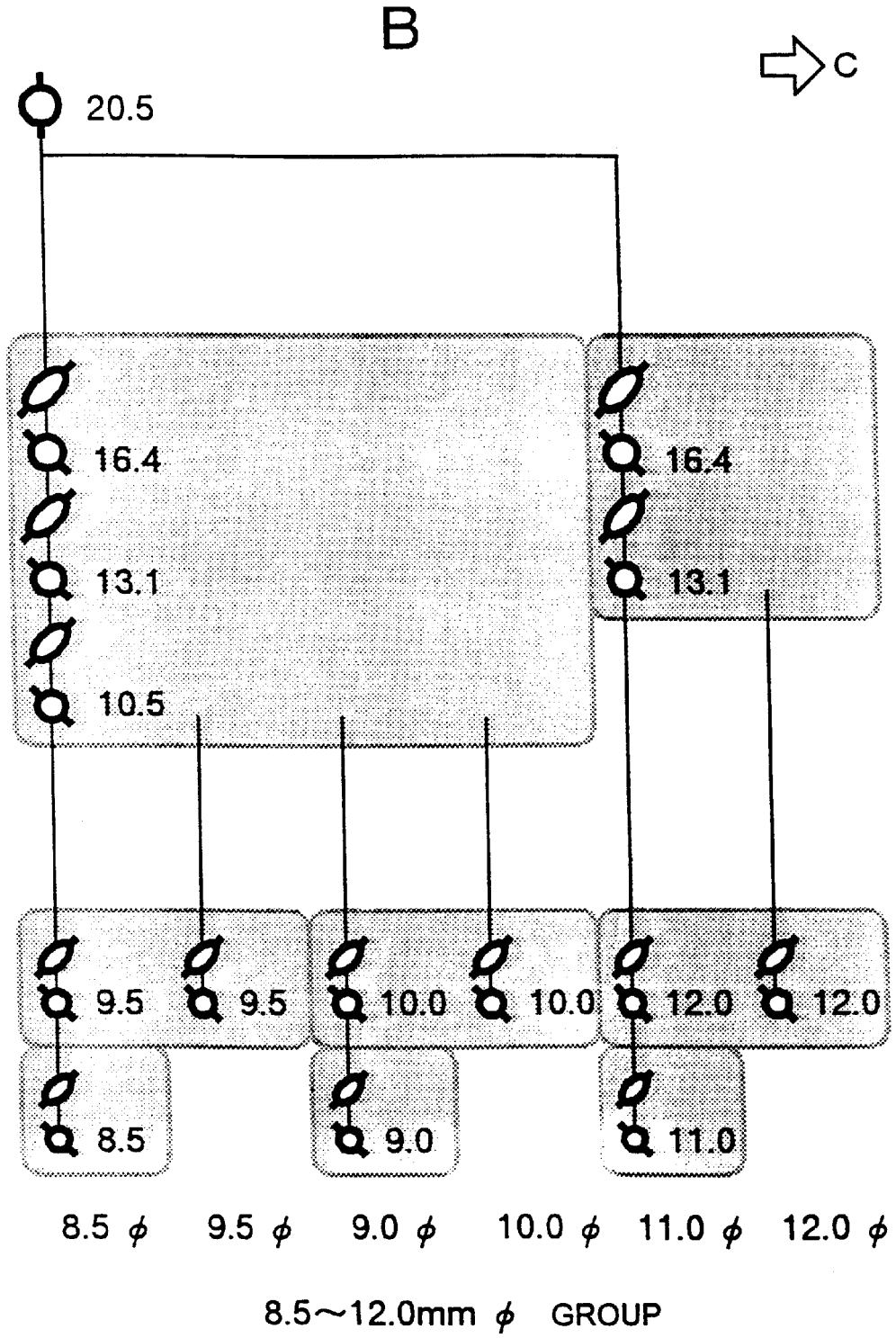
FIG. 3 PRIOR ART
FIG. 3 is an explanation similar to FIG. 2 for the steps subsequent to FIG. 2.
Figure 4:
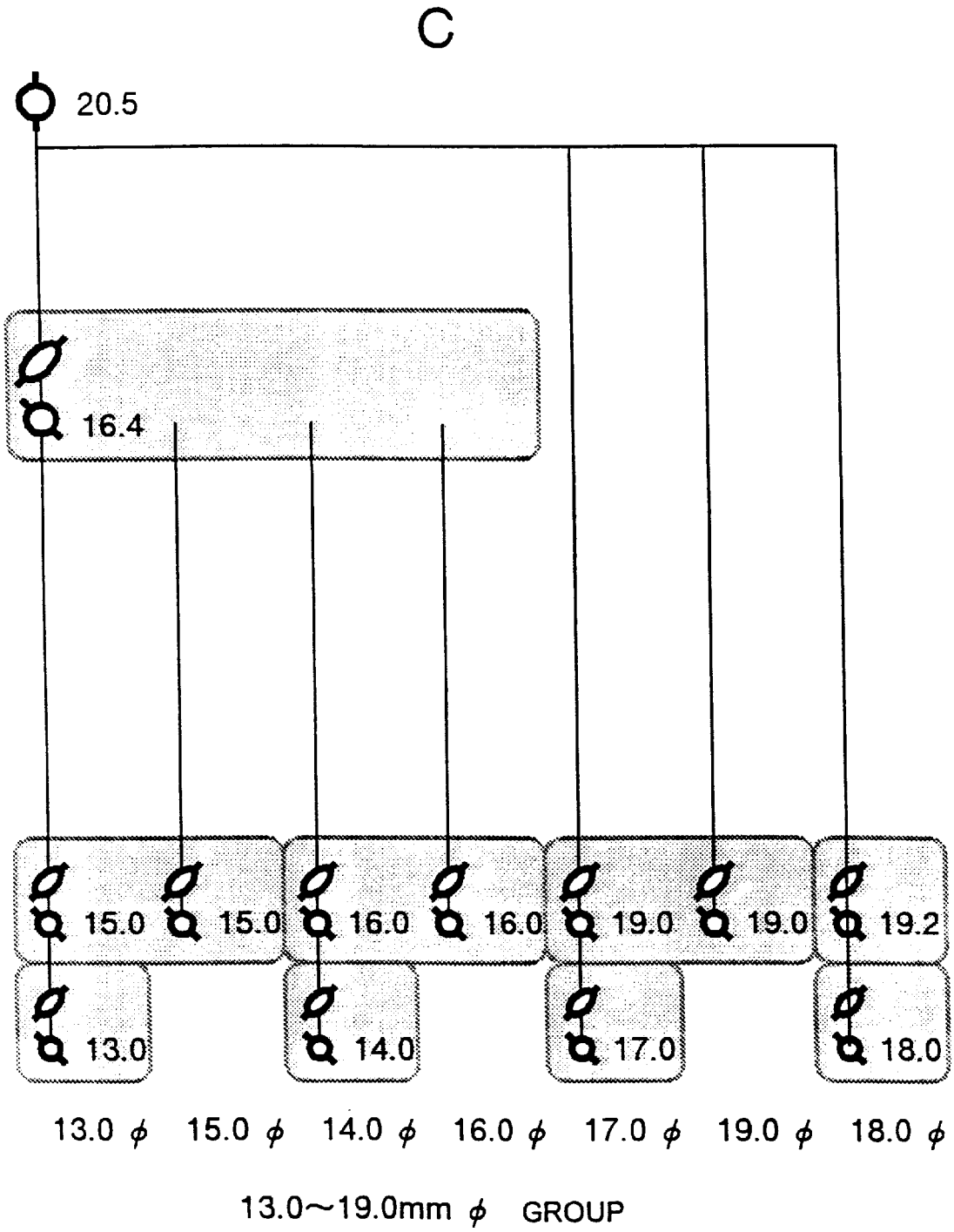
FIG. 4 PRIOR ART
FIG. 4 is an explanation like FIG. 2 for the steps subsequent to FIG. 3.
Figure 6:
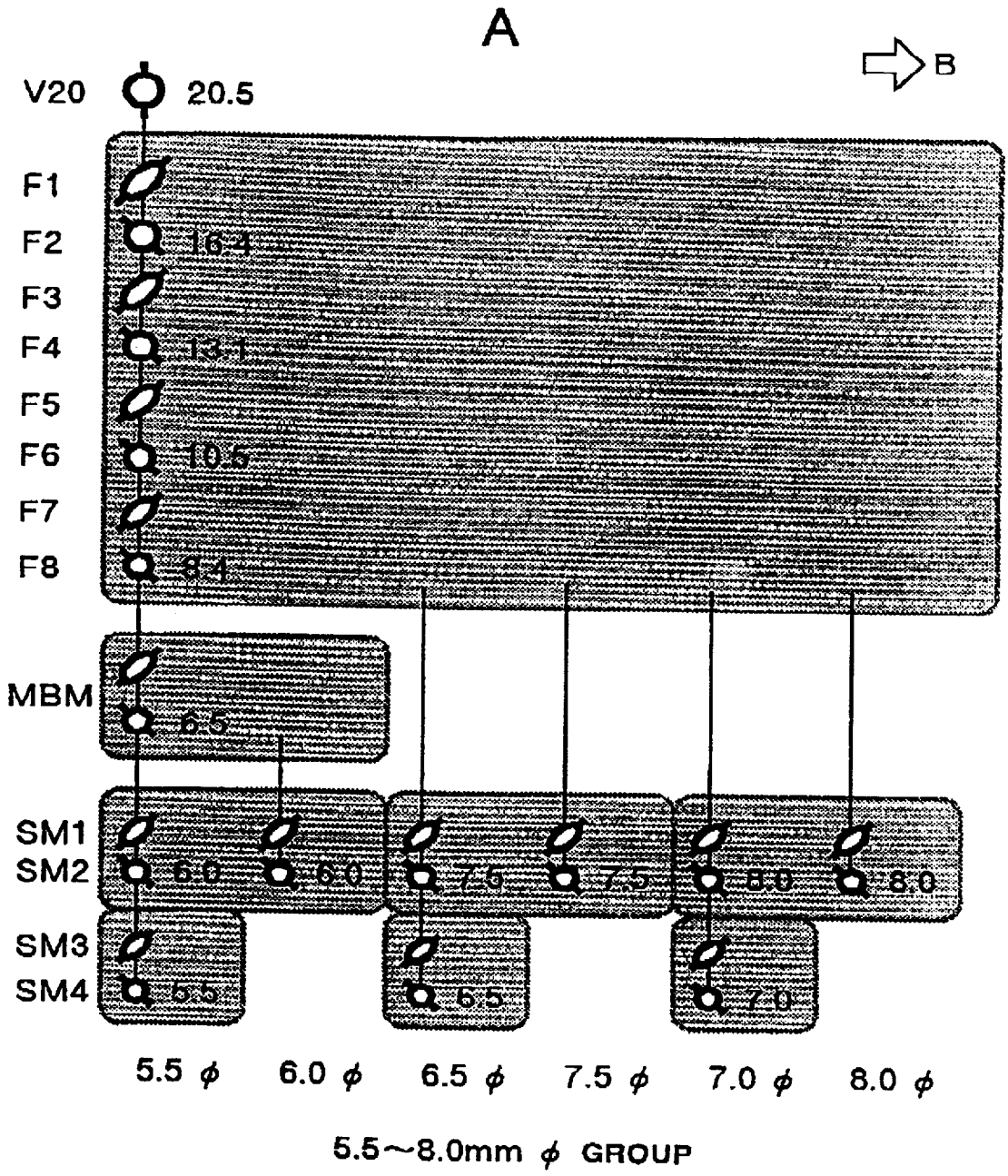
FIG. 6 is an explanation similar to FIG. 2 for rollers used, sections and diameters of the material in the process of rolling when wires of various sizes are produced by using the wire rolling mill shown in FIG. 5.
Figure 7:
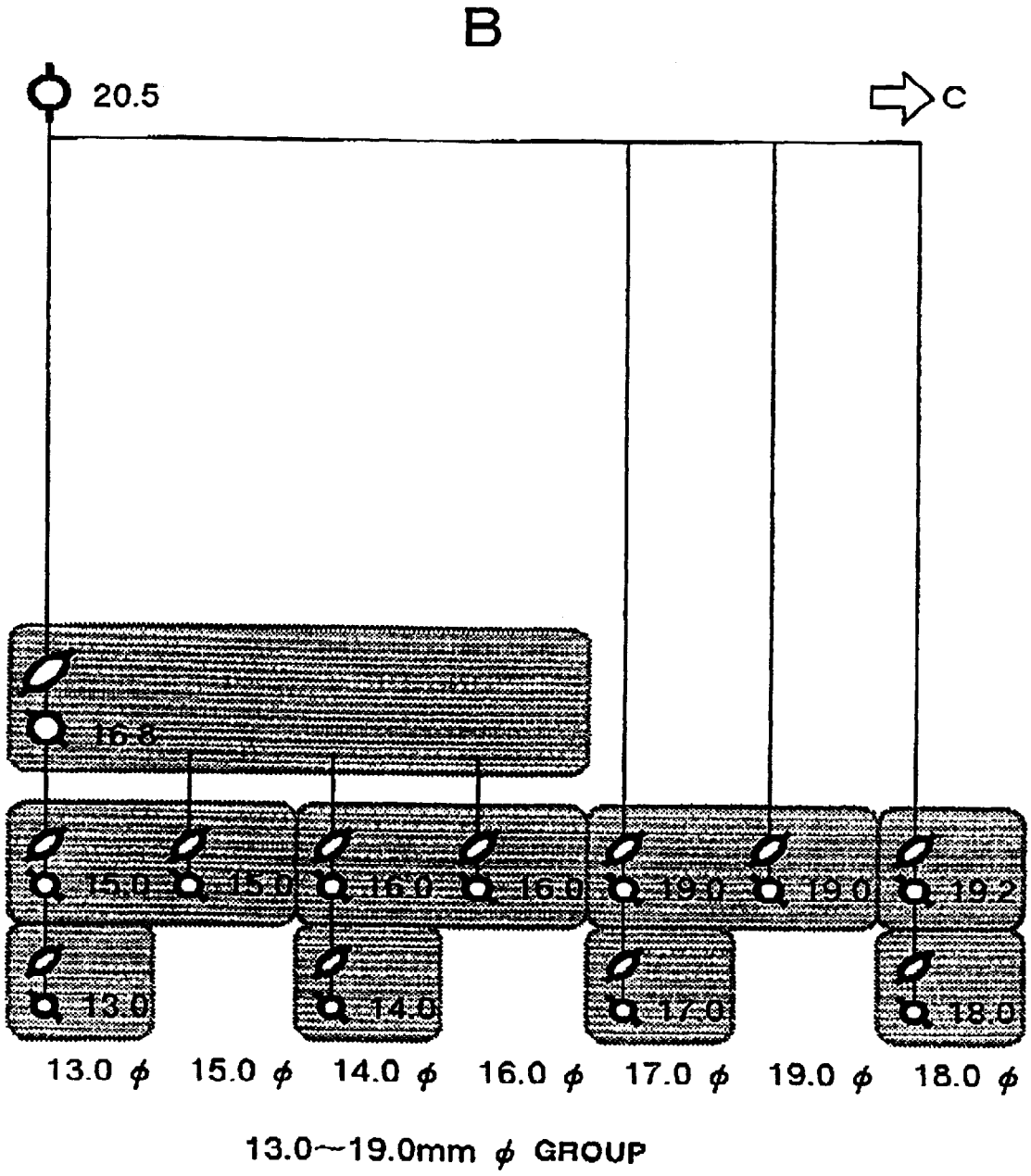
FIG. 7 is an explanation similar to FIG. 5 for the steps subsequent to FIG. 5.
Figure 8:
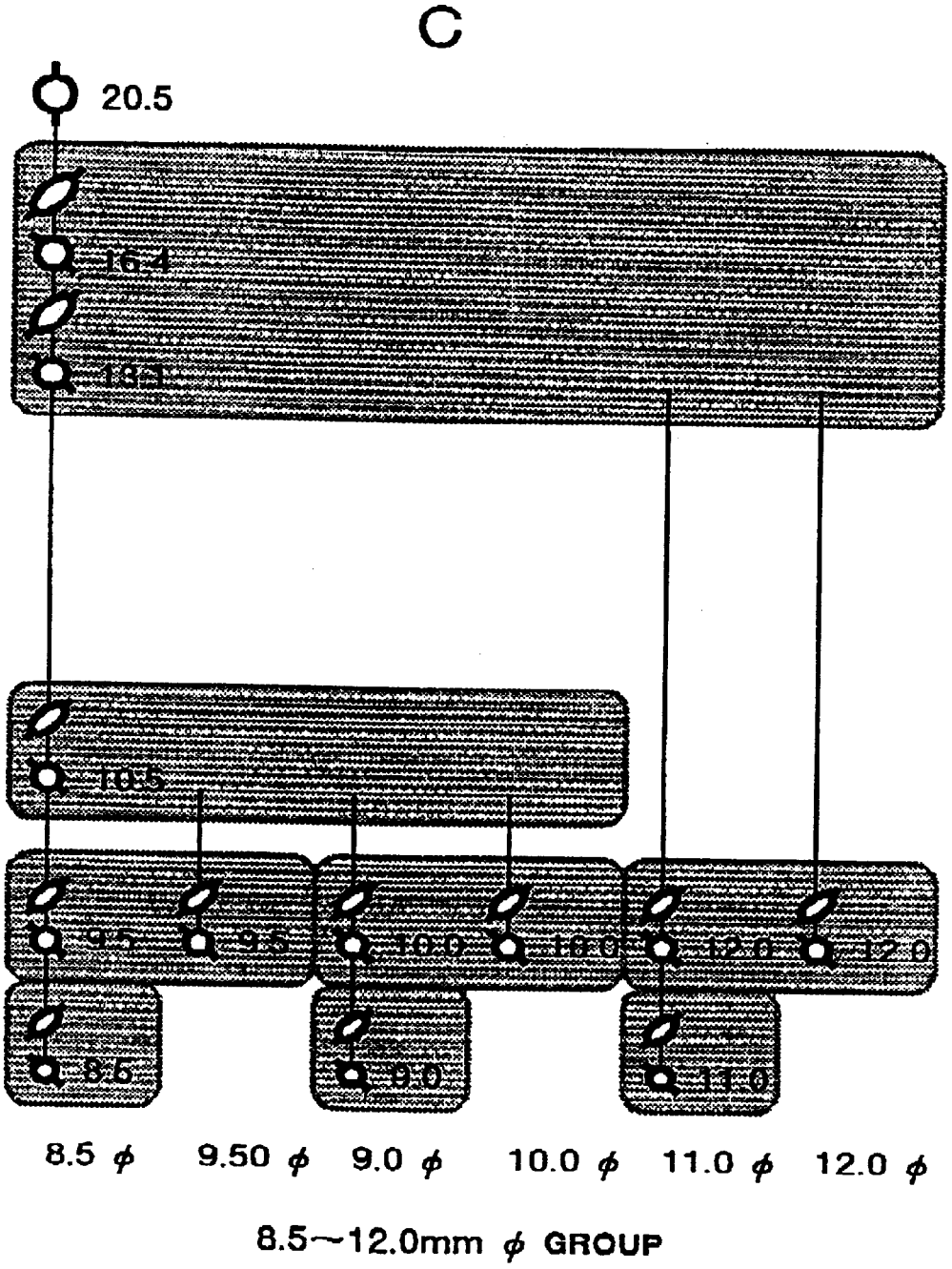
FIG. 8 is an explanation similar to FIG. 5 for the steps subsequent to FIG. 7.

In accordance with the present invention, round rods of a carbon steel having diameter 20.5 mm were used as the starting material, and rolling was carried out in accordance with the sequences shown in FIGS. 6–8 to obtain wire products having diameters as shown in the Figures. In these Figures the parts demarcated with lines, round circles and oval shapes, and the numerical figures added therefore have the meanings as explained with regard to FIGS. 2–4.

The rolling mill combinations shown diagrammatically in FIG. 6 show, for example, the sequences employed in cases 1 to 6 in table 1. In case 1, all rollers in the two groups of the block mill BM1 and BM2 are employed, also, the mini block mill (MBM) is operational and all sets of rollers of the sizing mill (SM1 and SM2) are in use. Case 2 is the same as case 1 except that the final sizing mill set (SM2) is dummied by shifting the set (SM2) from the pass line. Case 3 is achieved by employing different roll sets (SM1(c) & SM1 (d)) on the sizing mills and dummying the MBM. Case 4 is the same as case 3 except that the second set of sizing rolls (SM2) are dummied. In case 5, the MBM remains dummied and different rolls (SM1(t) & SM2(g)) are employed as the sizing mills. Case 6 is the same as case 5 except that the second set of sizing rolls (SM2) are dummied.

In analogous manner, FIGS. 7 and 8 shown other combinations for rolling specific calibre wire rod which are also listed in Tables 1 and 2.

By wire rolling in accordance with the present invention, which uses reducers and by-passes, it is possible to produce wires having various diameters from one starting material without changing rollers of the block mill. Because changing rollers of the block mill requires, as noted before, considerable time and labor, elimination of the necessity of changing rollers results in not only increased production efficiency but also decreased number of rollers to be used.

The fact that the product sizes can be easily changed covers drawback of the conventional technology that it is forced to produce, once the rollers are changed, a considerable quantity of products at once, and realizes "many grades-small quantity" production without undesirable increase of costs. This merit contributes also to lighten the problems of scratching at handling and rusting during storage mentioned before.

What is claimed is:

1. A method of rolling wire rods having different selected final diameters from a rod of a single diameter supplied from a roughing mill along a pass line wherein the mill includes an intermediate block mill for receiving rod from the roughing mill, the block mill having rollers arranged in a front group and a rear group, each of which can be dummied, a mini block mill for receiving rod from the block mill and which is shuntable from the pass line, and a sizing mill for receiving rod from the mini block mill, the sizing mill having plural sets of rollers, at least one of which sets is shuntable from the pass line, said method comprising selecting combinations of the block mill roller groups, mini block mill and sizing roller sets and rolling rod through the selected combination so as to produce a wire rods having the selected final diameters.

2. A rolling mill for rolling wire rod having different selected final diameters from a single diameter supplied from a roughing mill along a pass line, said rolling mill comprising an intermediate block mill for receiving rod from a roughing mill, the block mill having a front group of rollers and a rear group, each of which can be independently dummied, a mini block mill for receiving rod from the block mill and which can be shunted between an operative position on the pass line and a non-operative position away from the pass line, and a sizing mill comprising at least two sets of rollers, at least one of which sets is capable of being shunted between an operative position on the pass line and a non-operative position away from the pass line, the rollers of the block mill, mini block mill and sizing mill being selectable in various combinations to produce wire rods of the selected final diameters from a single diameter wire rod supplied by the roughing mill.

* * * * *